United States Patent [19]

Hauff et al.

[11] Patent Number: 4,950,403

[45] Date of Patent: Aug. 21, 1990

[54] SCREEN SEGMENT FOR FILTERS FOR THICKENING FIBER SUSPENSIONS

[76] Inventors: Siegfried Hauff, Helenenweg 1, 7410 Reutlingen 1; Waldemar Schäfer, Sonnenhalde 6, 7411 St. Johann-Bleichstetten, both of Fed. Rep. of Germany

[21] Appl. No.: 154,634

[22] Filed: Feb. 10, 1988

[30] Foreign Application Priority Data

Feb. 27, 1987 [DE] Fed. Rep. of Germany ..... 3706402

[51] Int. Cl.[5] ..... B01D 33/23

[52] U.S. Cl. ..... 210/486; 210/331; 210/346; 264/DIG. 48; 209/403

[58] Field of Search ..... 210/486, 487, 331, 346, 210/347; 264/DIG. 48; 209/400, 403, 405

[56] References Cited

U.S. PATENT DOCUMENTS

| | | | |
|---|---|---|---|
| 1,685,085 | 9/1928 | Hoyt | 210/486 |
| 1,746,409 | 2/1930 | Sweetland | 210/486 |
| 1,767,078 | 6/1930 | Johnson | 210/486 |
| 2,444,147 | 6/1948 | Walton | 210/486 |
| 2,682,205 | 6/1954 | Vincent . | |
| 2,964,194 | 12/1960 | Oliver | 210/486 |
| 3,679,061 | 7/1972 | Davis | 210/486 |
| 3,917,534 | 11/1975 | Moore | 210/486 |
| 4,077,887 | 3/1978 | Langrik | 210/486 |
| 4,330,405 | 5/1982 | Davis | 210/486 |
| 4,637,876 | 1/1987 | Dosoudil | 210/331 |
| 4,686,040 | 8/1987 | Nilsson | 210/331 |

FOREIGN PATENT DOCUMENTS

| | | | |
|---|---|---|---|
| 2375893 | 9/1978 | France | 264/DIG. 48 |
| 1275504 | 4/1970 | United Kingdom . | |

OTHER PUBLICATIONS

German Language Brochure-Finckh-Rundsieb-Eindicker mit Wabenzylinder oder Faltensiebzylinder-8 pages.

German Language Brochure-Hedemora Pulp Machinery-Scheibenfilter-6 pages.

*Primary Examiner*—David L. Lacey
*Assistant Examiner*—Thomas M. Lithgow
*Attorney, Agent, or Firm*—Neuman, Williams, Anderson & Olson

[57] ABSTRACT

In a sector-shaped screen segment for disk filters or thickeners with a folded screen for thickening fiber suspensions comprising a frame, two screen carriers and a screen resting on the outer sides of the screen carriers, manufacture is rendered simpler and less expensive by the frame and the screen carriers forming an integral molded part in which the screen is embedded in the molding process.

13 Claims, 2 Drawing Sheets

SCREEN SEGMENT FOR FILTERS FOR THICKENING FIBER SUSPENSIONS

BACKGROUND OF THE INVENTION AND DISCUSSION OF THE PRIOR ART

The invention relates to a sector-shaped screen segment for rotating disk filters or thickeners with a folded screen for thickening fiber suspensions.

In the production of wood pulp and cellulose and the processing of waste paper and other fibrous materials, a fiber suspension is often treated at substance densities of between approximately 0.3% and approximately 3%. The further processing of the raw materials by grinding or bleaching and the temporary storing of the fibrous material in vats require a higher concentration which is economically obtainable with rotating disk filters or thickeners with a folded screen. In both cases, a drum which rotates about a horizontal axis dips into a trough into which the fiber suspension which is to be thickened is continuously introduced. The drum which is covered on the outside with a woven screen is of accordion-like configuration to increase the screen area. In a known disk filter, such as, for example, that offered by Hedemora Pulp Machinery, the drum is comprised of several disk-shaped units which are mounted on a common, rotatably mounted and driven supporting pipe and each consists of several sector-shaped screen segments which are contiguous along radii and are covered on the outer side with the woven screen which together with screen carriers defining a cavity, forms the end faces of the filter disks.

As the disk filter dips into the fiber suspension and turns slowly in it, water passes out of the fiber suspension through the screen into the interior of the rotating drum, and a fibrous fleece forms on the outer side of the screen and increases the filtering effect. The arrangement is designed to produce between the level of the fiber suspension in the trough and the level of the water flowing off from the drum interior through the supporting pipe, a hydrostatic pressure difference which causes continuous filtration. To remove from the filter disks the continuously increasing layer of fibers accumulating on the screen as the fiber suspension in the trough passes through it, there are arranged on the trough, above the fiber suspension to be filtered, rake-like scrapers which form a kind of chute on which the layers of fibers which have been removed from the filter disks slide to a location outside the trough. Removal of the layers of fibers from the screen may be facilitated by provision of a spraying pipe above the disk filter to spray off and thereby remove the layers of fibers from the screen.

In the known disk filter described above, the screen segments have a kind of frame with two lateral, radially extending legs and a circumferentially outer leg, and the screen carriers arranged in axially spaced relation to each other consist of a welded wire grid with a woven plastic screen resting on it. The screen forms a filter bag which has a zip fastener and has been shrunk onto the frame and the screen carriers.

In known thickeners with a folded screen, the circumferentially extending folds are less deep than in a disk filter. In another known disk filter, the screen carriers consist of perforated metal plates with apertures of relatively large diameter.

The known sector-shaped screen segments are disadvantageous in several respects: Firstly, the supporting structures for the woven screen consisting of frame and screen carriers involve quite high manufacturing expenditure, which results in relatively high costs. In addition, these screen structures are not particularly stable —it must be remembered that the filter disks have a diameter of the order of magnitude of 2 m —and even if the rotating filter disks run slightly out of true at the sides, this causes the woven screen to run sideways against the scrapers removing the layer of fibers from the drum, the spraying pipes and the like, and, for this reason, in the known disk filter described above, the filter disks are guided at the sides in the area in which the layer of fibers is removed. Finally, relative motions between the woven screen and the screen carriers supporting it result in wear and tear of the screen and hence in decreased service life.

The object underlying the invention is to create a sector-shaped screen segment (viewed from the side, the known screen segments described above have approximately the shape of the sector of a circle with the top cut off) for rotating disk filters or thickeners with a folded screen for thickening fiber suspensions which is simpler and hence less expensive to manufacture, particularly also as far as attachment of the screen is concerned.

SUMMARY OF THE INVENTION

Proceeding from a screen segment with a frame having a radially outer leg and a lateral leg at each of its two sides which, in particular, extend in the radial direction, and attached to said legs two screen carriers arranged in —axially —spaced relation to each other and forming together with a screen resting on them the two main surfaces of the screen segment, this object is achieved, in accordance with the invention, by at least the frame legs being in the form of molded parts in which the screen is embedded, with provision being made in a preferred embodiment for the screen to also be embedded in the screen carriers which are components of a molded part. Manufacture is rendered particularly simple by the screen carriers being molded to the frame legs.

Accordingly, as in the known screen segments, in the inventive construction, too, the woven screen forms the main surfaces of the screen segment at the sides or the end faces, more particularly, not only when the screen simply rests on the screen carriers but also in the preferred embodiment in which the screen is also embedded in the screen carriers which are in the form of molded parts, insofar as embedding is carried out in such a way that the material of the screen carriers does not protrude beyond the outer side of the woven screen. No further special steps are required for attaching the screen since it is automatically attached to the frame and/or the screen carriers when these parts of the screen segment are being molded. Two separate screen sections which have been cut to size can be used for the two main surfaces but it is, of course, also possible, as in the known disk filter described above, for a filter bag to be placed in the mold and for the embedding to be carried out when the frame and/or the screen carriers are being molded.

In principle, the complete frame of a screen segment and also its two screen carriers can be manufactured as an integral molded part. However, to enable use of simpler and hence less expensive molds, an embodiment is recommended in which the frame legs are divided along a center plane extending perpendicularly to the axis of rotation of the filter disk and the frame leg halves together with the associated screen carrier of the respective segment half form an integral, half-dish-like molded part in which a sector-shaped screen section which has been cut to size is embedded. The thus manufactured screen segment halves can then be adhered, welded, screwed together or simply attached to each other in some other way. However, a screw connection is preferred as a damaged or worn screen segment or screen segment half is then particularly easily and quickly replaced, which shortens the idle time of the disk filter or thickener with folded screen.

The molded parts can be metal die-cast or injection molded parts. The inventive screen segments are particularly inexpensive and light if the molded part is a plastic injection molded part.

Any suitable material can be used for the screen but a woven structure made of rust-proof steel wires or plastic filaments or plastic wires is particularly recommended.

It has also proven to be advantageous in the inventive screen segment for each screen carrier to be in the form of a grid comprised of bars and, in particular, for the bars to be arranged so as to extend radially and in the direction of rotation. The bars extending in the direction of rotation are then set back in the direction toward the segment interior in relation to the radially extending bars and the screen is embedded only in the radially extending bars as the form stability of the woven screen surfaces is then particularly good on account of the slight spacing between the supports by which the screen is held.

Particular emphasis is to be placed on the fact that the embedding of the screen in the screen carriers and/or the frame prevents relative motions between the screen and the parts carrying it, above all, when the screen is embedded in the material of the screen carriers. The inventive screen segments, therefore, have a substantially longer service life than the screen segments known from the prior art. In this connection, it should, furthermore, be noted that it is, of course, not necessary for the screen to be embedded in the molded material throughout the entire thickness of the screen. It would, for example, be sufficient, in the case of a woven screen, for the wire or filament curvatures facing the screen carriers or frame legs to be embedded in the molded material even though embodiments are preferred in which the screen is embedded in the molded material to such a depth that the molded material is flush with the outer side of the screen.

Further features, advantages and details of the invention will become apparent from the following description and the appended drawings of two embodiments of the inventive screen segment. In the drawings:

DESCRIPTION OF THE PREFERRED EMBODIMENTS

Figure 3:
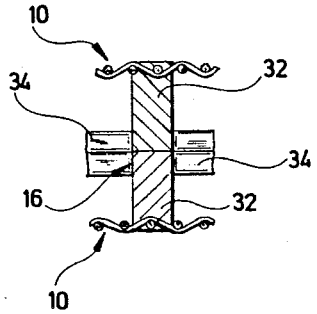
FIG. 3 is a section through a radially extending bar of one of the two screen carriers including an embedded screen according to line 3—3 in FIG. 1.
Figure 2:
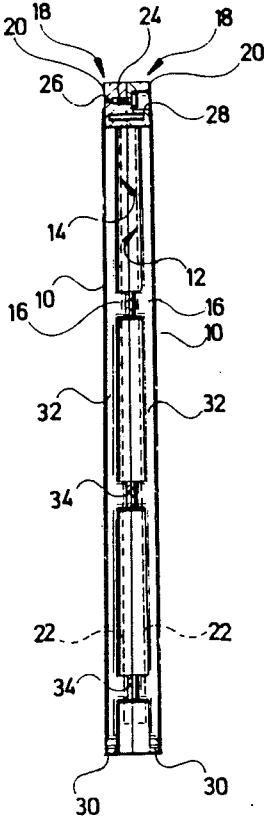
FIG. 2 is a section through the screen segment for the disk filter along line 2—2 in FIG. 1.
Figure 1:
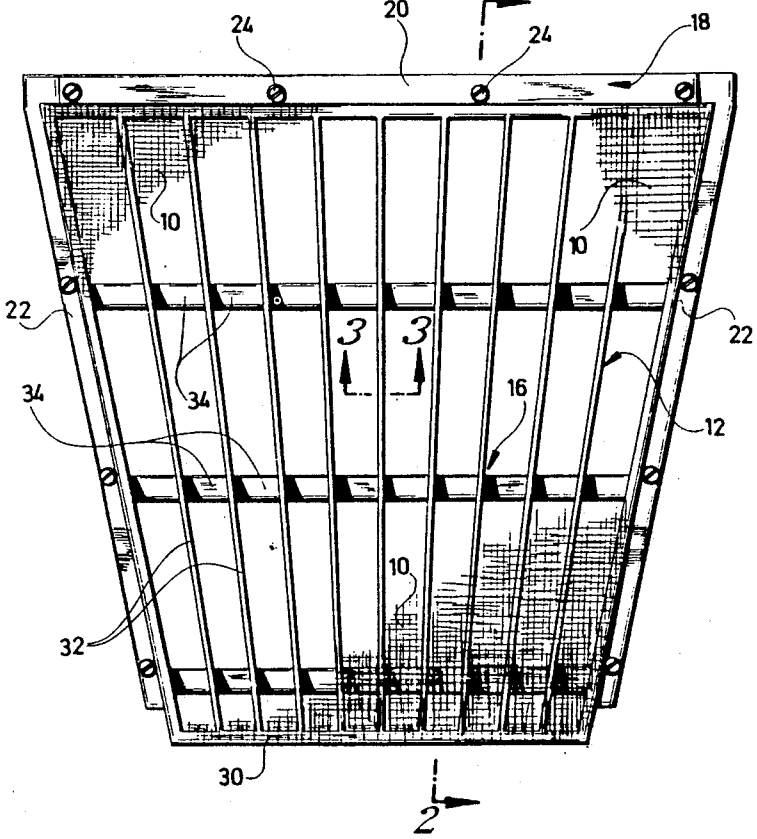
FIG. 1 is a front end view (in the axial direction) of an inventive screen segment for a disk filter.

The screen segment for a disk filter shown in FIGS. 1 to 3 consists essentially of two woven screen sections 10 which have been cut to size and two half-dishes 12, 14 in the form of integral molded parts, each of which forms a screen carrier 16 and a frame half 18. The two frame halves together produce a radially outer frame leg 20 and two lateral, radially extending frame legs 22 and are firmly connected to each other along these frame legs by means of screws 24 and threaded bores 26. Recesses 28 are provided in the half-dish 12 for accommodating the screw heads. As in the illustrated embodiment, the frame halves of the inventive screen segment are closed and, therefore, also have an inner frame leg 30, with the two halves of this inner frame leg being arranged in axially spaced relation to each other, as shown in FIG. 2, to enable the filtrate to flow down into a screen segment carrier.

The screen carriers 16 consist of radially extending bars 32 and bars 34 extending transversely thereto, which are integrally connected with one another and the frame halves 18 as the entire frame halves each form one single molded part, more particularly, a plastic injection molded part. The transverse bars 34 are set back in relation to the radial bars 32 in the direction towards the interior of the screen segment, as is clearly apparent from FIG. 2, while, in accordance with the invention, the outer end faces of the radial bars 32 are in alignment with the outer end faces of the frame halves 18. Since the transverse bars 34 lie against one another, as likewise shown in FIG. 2, the previously made statement that the screen carriers are to be arranged in axially spaced relation to each other, is, of course, only to be so interpreted that the bearing surfaces of the two screen carriers supporting the screens lie in axially spaced relation to each other.

In accordance with the invention, each of the woven screen sections 10 which has been cut to size is embedded in the screen supports formed by the outer end faces of the frame legs 20, 22, 30 and of the radial bars 32 at least throughout part of the thickness of the screen, but preferably throughout the entire screen thickness, as is apparent from FIG. 3 which shows in section one of the radial bars 32 and one of the woven screen sections 10 cut to size. From this section it is also evident that in the preferred embodiment of the inventive screen segment, the material of the carrying structure does not protrude outwardly beyond the outermost elevations in the screen, i.e., the woven screen material.

The two frame halves can be particularly simply and inexpensively manufactured as plastic injected molded parts. A woven screen section 10 cut to size is placed in the injection mold and the frame half is then injected, the woven screen being simultaneously embedded in the plastic forming the frame half and thereby anchored on the frame and on the screen carrier.

Figure 4:
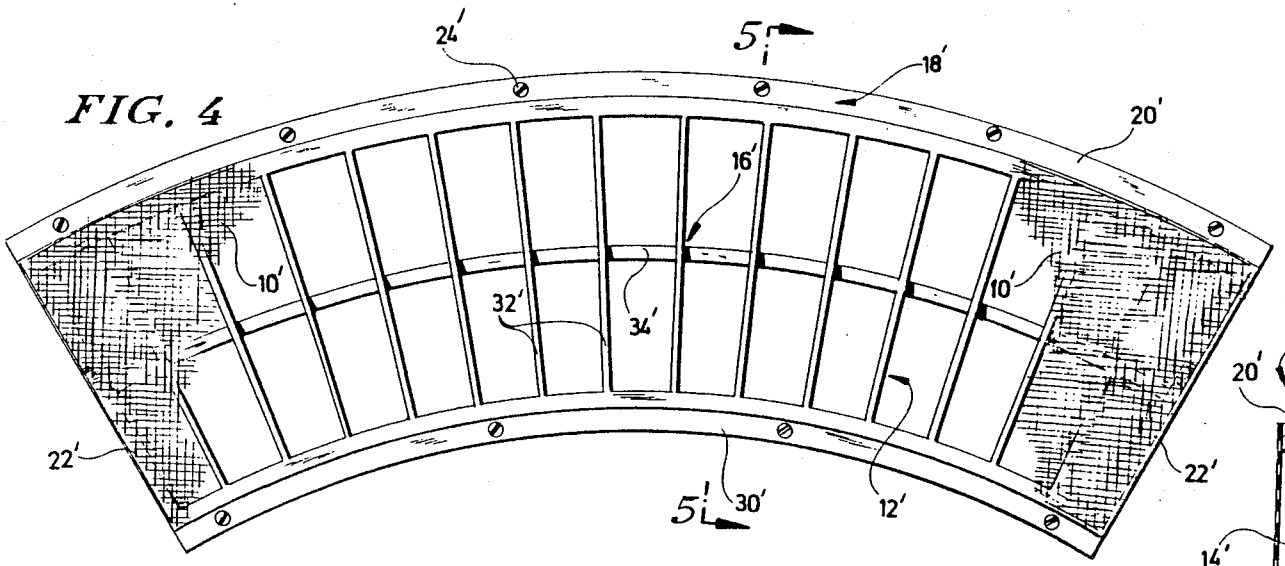
FIG. 4 is a front end view corresponding to FIG. 1 of an inventive screen segment for a thickener with a folded screen.
Figure 5:
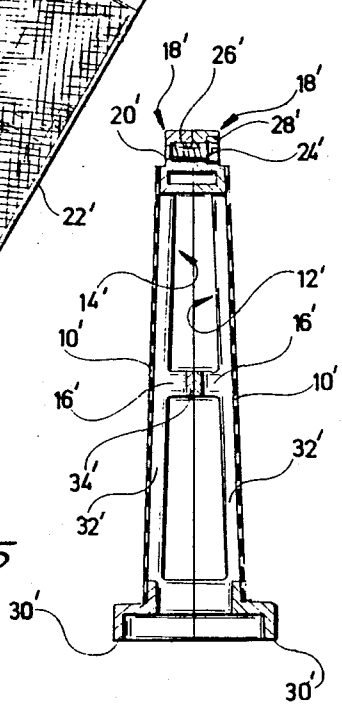
FIG. 5 is a section through this screen segment according to line 5—5 in FIG. 4.

Since the screen segment shown in FIGS. 4 and 5 differs from a thickener with a folded screen essentially only in that the radial extension of the frame and of the screen carriers is smaller than in the case of a screen segment for a disk filter, the elements of the second embodiment corresponding to those of the first embodiment have been designated by the same reference numerals as in FIGS. 1 to 3, but with the addition of an apostrophe, which eliminates the necessity for a description of the details shown in FIGS. 4 and 5.

It is particularly advantageous that the bars of the two frame halves which do not carry the woven screen are of such arrangement and dimensions that, on the one hand, they lie against one another (vide FIGS. 2 and 5), which increases the stability of the screen segment, yet, on the other hand, there remains a relatively large flow cross-section for the filtrate between the outwardly oriented edges of these bars and the woven screen material.

The invention further relates to the method for manufacturing the screen segment which is characterized in that the screen is placed in a mold for manufacture of the frame and/or the screen carrier and the frame and/or the screen carrier is/are then cast.

What is claimed is:

1. A screen segment for a rotary disk filter having an axis of rotation said screen segment comprising a frame means having opposed surfaces and substantially defining the outer periphery of said screen segment and extending substantially perpendicularly to the axis of rotation said frame means including radially spaced outer and inner legs as well as lateral legs connected to opposed ends of said outer leg and extending toward said axis of rotation and connected to opposed ends of said inner leg; screen carrier means having opposed supporting surfaces and encompassed by and joined to said frame means; spaced screens defining opposed outer main surfaces of said screen segment and supportably mounted on the opposed surfaces of said screen carrier means and said frame means; said screen carrier means and said frame means comprising molded elements in which said screens are supportably embedded.

2. The screen segment as defined in claim 1, in which carrier means and said frame legs comprise an integral molded unit in which said screens are embedded in opposed face portions thereof so as to define opposed substantially coextensive faces of said screen segment.

3. The screen segment as defined in claim 1, said frame legs are divided along a center plane of the screen segment extending substantially perpendicularly to the axis of rotation thereby defining two frame halves; each frame half being integrally formed with one of said screen carrier means and forming a half-dish-like molded part.

4. A sector-shaped screen segment for a rotary disk filter having an axis of rotation, said screen segment comprising a frame extending substantially perpendicularly to the axis of rotation and having an outer leg radially spaced from the axis of rotation and a lateral leg connected to each of the ends of said outer leg, said lateral legs converging toward said axis of rotation; screen carrier means attached to at least two of said legs, said screen carrier means having screen supporting elements and openings therebetween; and two axially spaced filter screen means defining two opposed main surfaces of the screen segment, said filter screen means being supported by said screen supporting elements; said screen carrier means being in the form of at least one molded part in which said filter screen means are embedded.

5. A screen segment as defined in claim 4, wherein the frame is in the form of at least one molded part into which said filter screen means are embedded, and wherein said screen carrier means is molded to said frame.

6. A screen segment as defined in claim 4, wherein said screen carrier means comprises two screen carriers each being provided with screen supporting elements, including axially spaced, screen-bearing surfaces, and wherein said frame is divided along a center plane of the screen segment extending substantially perpendicularly to the axis of rotation so as to define two discrete frame halves, and wherein each frame half together with one of the screen carriers forms an integral, half-dish like molded part.

7. A screen segment as defined in claim 4 or 5, wherein the molded part is a plastic injection molded part.

8. A screen segment as defined in claim 4, wherein said filter screen means are comprised of woven rust-proof steel wires.

9. A screen segment as defined in claim 4, wherein said filter screen means are comprised of woven plastic filaments.

10. A screen segment as defined in claim 6, wherein said two half-dish-like molded parts are joined by screws along the frame legs.

11. A screen segment as defined in claim 4, wherein the screen supporting elements for said filter screen means are formed by bars arranged in grid form.

12. A screen segment as defined in claim 11, wherein said bars include first bars which extend substantially parallel to said lateral legs and wherein second bars extend substantially parallel to said outer leg and are set back in the direction towards the segment interior in relation to the first bars, said filter screen means being embedded into the first bars only.

13. A screen segment as defined in claim 4, wherein said frame has an inner leg fixed to the radially inner ends of the lateral legs.

* * * * *